US007331795B2

(12) United States Patent
Duke

(10) Patent No.: US 7,331,795 B2
(45) Date of Patent: Feb. 19, 2008

(54) SPRING PROBE-COMPLIANT PIN CONNECTOR

(75) Inventor: Quach Duke, San Gabriel, CA (US)

(73) Assignee: Raytheon Company, Waltham, MA (US)

( * ) Notice: Subject to any disclaimer, the term of this patent is extended or adjusted under 35 U.S.C. 154(b) by 107 days.

(21) Appl. No.: 11/331,634

(22) Filed: Jan. 13, 2006

(65) Prior Publication Data

US 2007/0167035 A1 Jul. 19, 2007

(51) Int. Cl.
*H01R 12/00* (2006.01)

(52) U.S. Cl. ..... 439/66; 439/419; 439/482; 439/587

(58) Field of Classification Search ..... 439/824, 439/851, 66, 587, 591, 67, 219, 272–275; 324/761
See application file for complete search history.

(56) References Cited

U.S. PATENT DOCUMENTS 5,080,604 A * 1/1992 Rider et al. ..... 439/680
5,157,325 A * 10/1992 Murphy ..... 324/761
5,637,012 A * 6/1997 Ott ..... 439/482
6,503,089 B2 * 1/2003 Saijo et al. ..... 439/70
6,570,399 B2 * 5/2003 Yeghiayan et al. ..... 324/761
6,661,245 B1 * 12/2003 Reis et al. ..... 324/761
6,758,682 B1 * 7/2004 Kosmala ..... 439/66
6,902,416 B2 * 6/2005 Feldman ..... 439/219
7,114,973 B2 * 10/2006 Haggerty ..... 439/246
2006/0141815 A1 * 6/2006 Li ..... 439/66

* cited by examiner

*Primary Examiner*—Briggitte R. Hammond
(74) *Attorney, Agent, or Firm*—Leonard A. Alkov

(57) ABSTRACT

Provided is an electrical connector for interconnecting electrical components such as a printed wiring assembly to one or more additional printed wiring assemblies. The connector includes a housing containing one or more compliant pins, one or more spring probes, and an interconnect for mechanically and electrically interfacing the pins with the probes. An alignment pin mounted in the housing helps to ensure alignment between one end of the connector and a corresponding PWA. In use, the compliant pins are inserted through a conformal coating and into vias in a first PWA, while the spring probes contact connector pads on a second PWA. Multiple connectors may be used to interconnect the two PWA, depending on PWA design.

6 Claims, 4 Drawing Sheets

SPRING PROBE-COMPLIANT PIN CONNECTOR

This invention was made with Government support under Contract No. F33657-99-D-0028 awarded by the Department of the Air Force. The Government has certain rights in this invention.

FIELD OF THE INVENTION

This invention relates generally to electrical connectors. More particularly, this invention relates to a combination spring probe-compliant pin electrical connector for use as an interconnect between printed wiring assemblies (PWAs) or other electrical components.

BACKGROUND

In general, a complex electrical system or device may consist of a printed wiring assembly (PWA) mated to one or more other PWAs with tens, hundreds or even thousands of electrical interconnects at various locations on the PWAs. Interconnecting large and/or complex PWAs can significantly increase the capability of a system or device, while simultaneously decreasing complexity and the overall footprint or volume of required electronics. Unfortunately, interconnecting large PWAs using conventional connectors known in the art is a near impossible task.

Connectors typically require precise alignment when mating two PWAs together, otherwise, the connectors may be damaged or destroyed. Often times, the process of mating two PWAs is a "blind" process. Stated differently, it is not possible to see the actual interface and interaction between a pin and a socket or a fork and a blade therefore, alignment during mating is critical. Precise alignment and the simultaneous mating of thousands of pins and sockets or fork and blades, without appreciable damage to multiple contacts, is a difficult challenge.

In addition to concerns about board/connector damage, electrical continuity and performance is an issue as well. When combining PWAs to form, for example, an antenna array backplane, the voltage drop from the components of a first PWA to the components of a second PWA must be minimized. Therefore traces on the printed wiring board (PWB) can not be routed to the PWB edge, and the use of standard high density connectors to connect the PWAs is precluded. The locations of the connectors relative to the two mating PWAs is critical. PWA alignment, which is difficult at best, becomes even more challenging as the number of interconnects are distributed to various locations on the PWA, and the number of interconnects and the size of the PWAs increases.

A further consideration when manufacturing PWAs is the challenge of masking connectors during the conformal coating process. If connectors must be mounted to the PWA prior to conformal coating, and if those connectors have moving parts, it is very difficult to adequately mask the connectors. As such, coating material may be deposited onto the moving parts of the connector, thereby destroying the connector's operational usefulness. In many instances, double-ended compliant pins can be used to interconnect two PWAs, thereby eliminating the need for masking. Nonetheless, pin-via alignment on the second or subsequent PWA remains an issue.

Hence, there is a need for an electrical connector that overcomes one or more of the drawbacks identified above.

SUMMARY

The electrical connector herein disclosed advances the art and overcomes problems articulated above.

In particular, and by way of example only, according to an embodiment, provided is an electrical connector including: a means for transferring an electrical signal between a housing and an electrically conductive pad on a first member; a means for conveying the electrical signal between the housing and an electrically conductive via in a second member; and a means, disposed within the housing, for interconnecting the means for transferring and the means for conveying, to facilitate the communication of the electrical signal between the first member and the second member.

In another embodiment, an electrical connector is provided, including: a housing; at least one spring probe positioned in the housing for interfacing with at least one electrically conductive pad on a first member; and at least one compliant pin, positioned in the housing and in electrical communication with the at least one spring probe, for interfacing with at least one electrically conductive via in a second member.

In yet another embodiment, provided is an improved printed wiring architecture including a first printed wiring assembly, a second printed wiring assembly, and an electrical connector interconnecting the first printed wiring assembly and the second printed wiring assembly, the improvement including: at least one spring probe positioned in the electrical connector for interfacing with at least one connector pad on the first printed wiring assembly; and at least one compliant pin positioned in the electrical connector, in electrical communication with the at least one spring probe, for interfacing with at least one via in the second printed wiring assembly.

In still another embodiment, provided is a method of manufacturing an electrical connector, including: selecting a connector housing; modifying at least one spring probe to include an interconnect device; positioning the at least one spring probe in the connector housing; mechanically interfacing one end of a compliant pin with the interconnect device; attaching a gasket to the connector housing; and verifying electrical connectivity between the at least one spring probe and the compliant pin.

DETAILED DESCRIPTION

Before proceeding with the detailed description, it should be noted that the present teaching is by way of example, not by limitation. The concepts herein are not limited to use or application with one specific type of spring probe-compliant pin connector. Thus, although the instrumentalities described herein are for the convenience of explanation, shown and described with respect to exemplary embodiments, the principles herein may be equally applied in other types of spring probe-compliant pin connectors.

Figure 1:
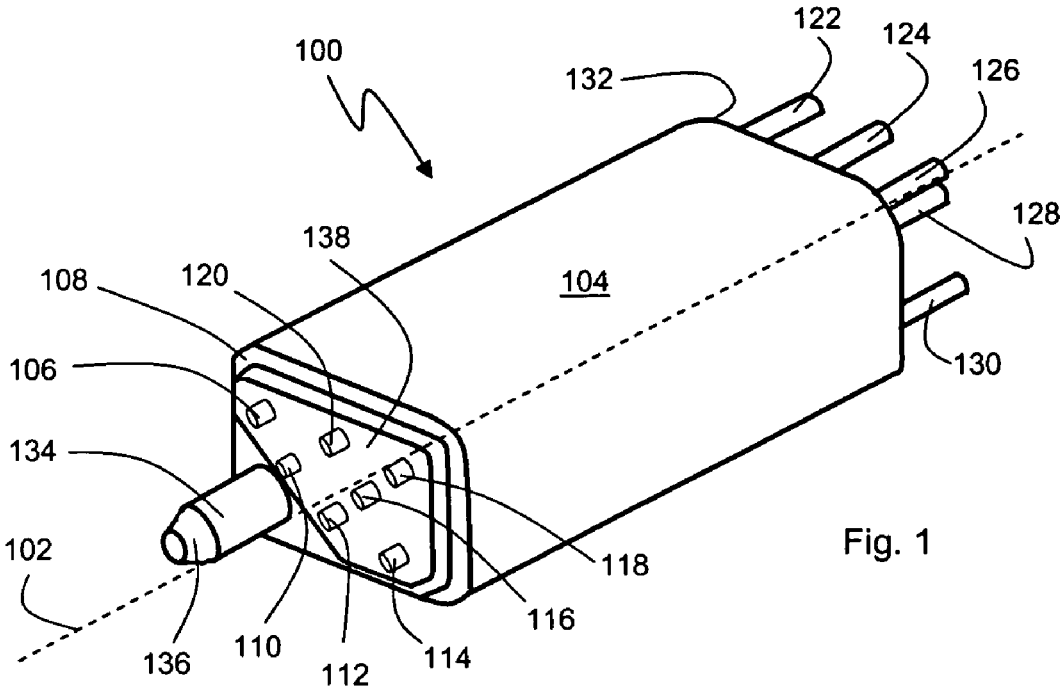
FIG. 1 is a perspective view of a spring probe-compliant pin connector, according to an embodiment.

FIG. 1 shows a perspective view of a spring probe-compliant pin electrical connector 100 in accordance with the present disclosure. In one embodiment, connector 100 may be used to transfer an electrical signal between printed circuit boards and/or printed wiring assemblies. As shown, electrical connector 100 defines a longitudinal axis 102, and includes a connector housing 104. Connector housing 104 is manufactured from an insulating material, and in at least one embodiment housing 104 is Vectra E1301.

As shown, connector housing 104 encapsulates at least one spring probe 106 for interfacing with, and contacting, a connector pad (not shown) on an electrically conductive component or member (not shown), and for passing an electrical signal from housing 104 to the pad. In at least one embodiment, the electrically conductive component is a PWA. Spring probe 106 protrudes from an end 108 of housing 104, and is oriented generally parallel to axis 102. Connector 100 may include a plurality of protruding spring probes oriented generally parallel to axis 102, of which spring probes 106, 110, 112, 114, 116, 118 and 120 are exemplary. In the embodiment disclosed in FIG. 1, connector 100 includes seven (7) spring probes 106, 110-120, however, it can be appreciated by those skilled in the art that connector 100 may include a greater or fewer number of spring probes, depending on the specific design and application of the connector 100.

In one embodiment, the spring forces associated with spring probes 106, 110-120 are in the range of 3.0 to 3.3 ounces. The spring forces, however, may be any force adequate to maintain an electrical connection between the spring probes 106, 110-120 and the connector pad(s), when the two are brought into physical contact. In at least one embodiment, the linear or working travel of one or more spring probes 106, 110-120 is in the range of 0.030 to 0.036 inches. The spring forces and working travel may be tailored to meet specific performance criteria or design constraints.

Still referring to FIG. 1, one or more compliant pins, of which compliant pins 122, 124, 126, 128 and 130 are exemplary, are included as part of connector 100. Compliant pins 122-130 are oriented longitudinally, generally parallel to axis 102 and spring probes 106, 110-120. As shown, compliant pins 122-130 protrude from an end 132 of connector housing 104 opposite end 108. Compliant pins 122-130 are structured and arranged to interface with one or more vias (not shown) in an electrically conductive component or member (not shown), and to transfer a current or electrical signal between housing 104 and the one or more vias. In at least one embodiment, the electrically conductive component is a PWA.

An alignment pin 134 extends outward from end 108 in a direction substantially parallel to axis 102. Alignment pin 134 is structured and arranged to interface with an aperture (not shown) in a PWA or other electrically conductive component, to help ensure connector 100 is properly aligned and in contact with the PWA. In at least one embodiment, alignment pin 134 includes a chamfered end 136 for facilitating the alignment and seating process. Alignment pin 134 may be an integral or molded part of connector housing 104, or alternatively, alignment pin 134 may be a separate component integrated into housing 104.

As shown in FIG. 1, a gasket 138 extends outward from end 108 to surround a portion of the spring probes 106, 110-120 and the alignment pin 134. Gasket 138 is positioned to seal any gap between end 108 and a corresponding PWA when spring probes 106, 110-120 are in intimate electrical and physical contact with a connector pad(s). Further, gasket 138 may provide lateral stability in the form of frictional forces opposing the lateral movement of connector 100 during use. In one embodiment, the material for gasket 138 is nitrile.

Figure 2:
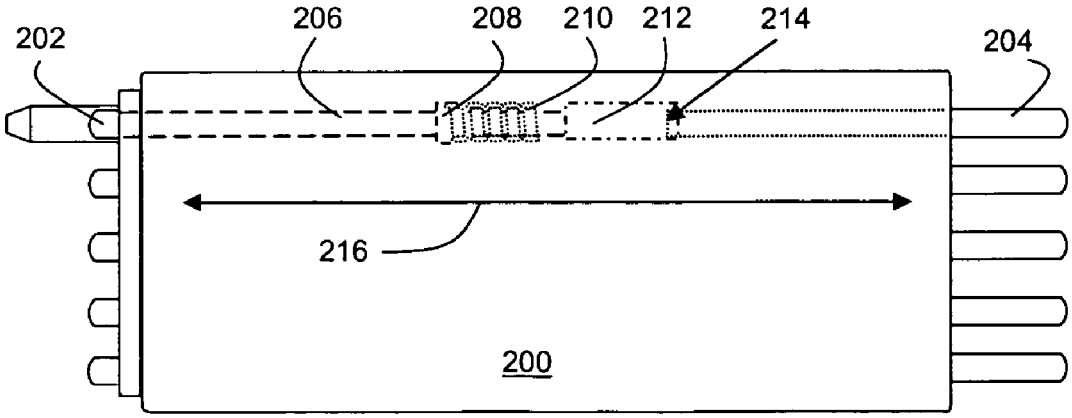
FIG. 2 is a side view of a spring probe-compliant pin connector, according to an embodiment.

Considering now a spring probe-to-compliant pin interface in greater detail, FIG. 2 depicts one such combination in an electrical connector 200. As represented in FIG. 2, each spring probe 202 aligns with a corresponding compliant pin 204 which is substantially parallel to the spring probe 202. Spring probe 202 may include a shaft 206 and post or plunger 208. In one embodiment, post 208 is mechanically connected to a spring mechanism 210. In particular, post 208 may be bonded, welded, or otherwise affixed to spring mechanism 210. In this way, the spring forces imparted by spring mechanism 210 act to hold spring probe 202 in contact with a connector pad (not shown). It can be appreciated that post 208 is illustrative of but one technique known in the art for interfacing a spring mechanism 210 to a shaft 206 of spring probe 202.

An interconnect 212 is mounted to spring probe 202 to receive one end 214 of compliant pin 204. In at least one embodiment, interconnect 212 is a barrel. Interconnect 212 may be welded, bonded, or otherwise attached to one end of spring probe 202. The mechanical interconnection of spring probe 202 and compliant pin 204, via interconnect 212, ensures electrical continuity through the length of connector 200, allowing current to flow as indicated by arrow 216. It can be appreciated that each spring probe-compliant pin pair of connector 200 is structured and arranged in substantially the same manner as the spring probe 202 and compliant pin 204 depicted in FIG. 2. As such, connector 200 may be used to interconnect two electrically conductive components, such as PWAs, wherein it is important to maintain an electrical connectivity with minimal resistance.

Figure 3:
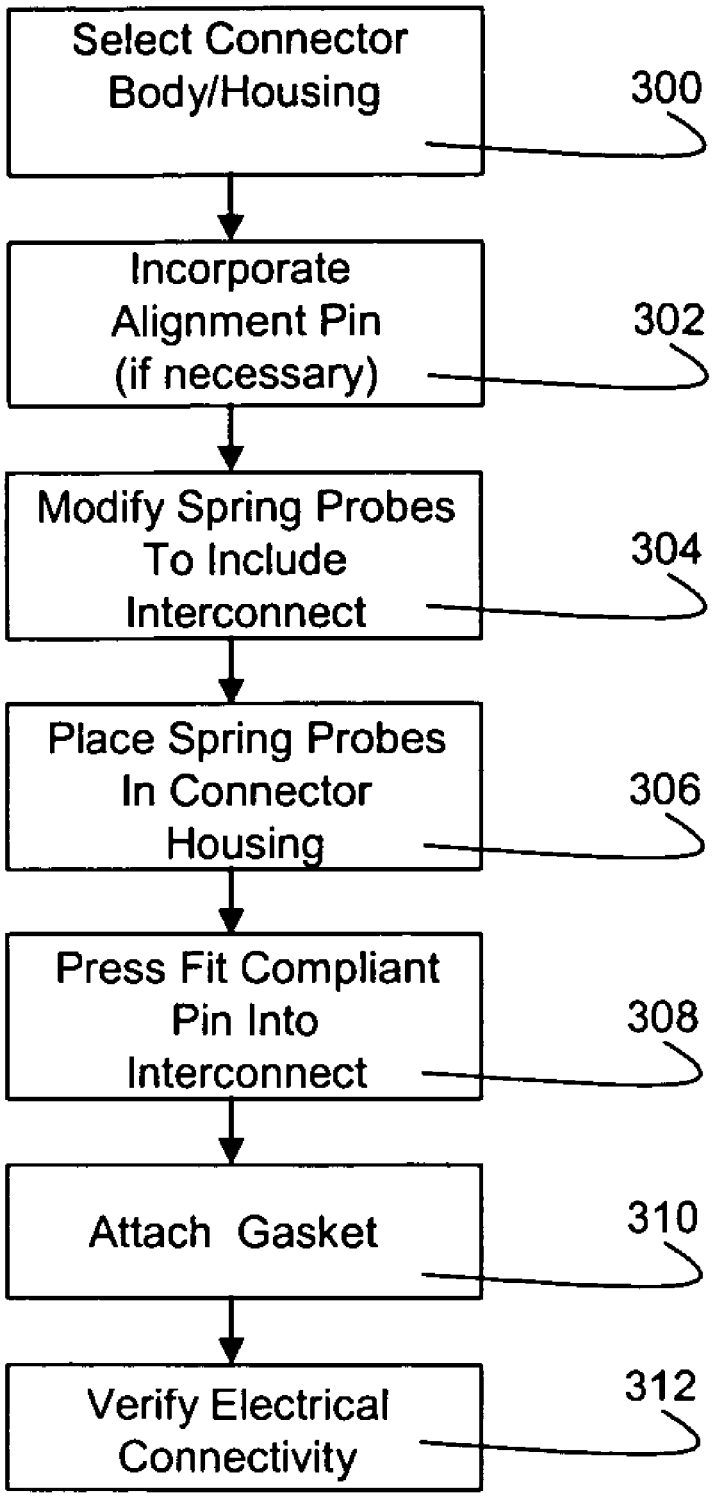
FIG. 3 is a flow chart of a method for manufacturing a spring probe-compliant pin connector, according to an embodiment.

Considering now FIG. 3, a flow chart of a method for manufacturing a spring probe-compliant pin connector is presented. The method presented is simplified for illustration purposes, and the sequencing of steps is not critical. In some instances, non-essential steps, well known in the art of manufacturing electrical components, have been omitted from FIG. 3.

In a first step, a housing or connector body is selected, block 300. The connector housing may include a molded alignment pin, or the alignment pin may be added in a subsequent step, block 302. The spring probe or probes are modified to include an interconnect (e.g. a barrel), block 304, and then the spring probes are place in the connector housing, block 306.

Once the spring probes are in position within the connector housing, one end of each compliant pin is forced or wedged into one end of a corresponding interconnect, i.e. the end facing the compliant pin, block 308. In this way, a mechanical press fit is established between each interconnect and compliant pin. The gasket is placed over the "spring-probe" end of the connector housing, block 310, and a final check of electrical connectivity is conducted, block 312.

Figure 4:
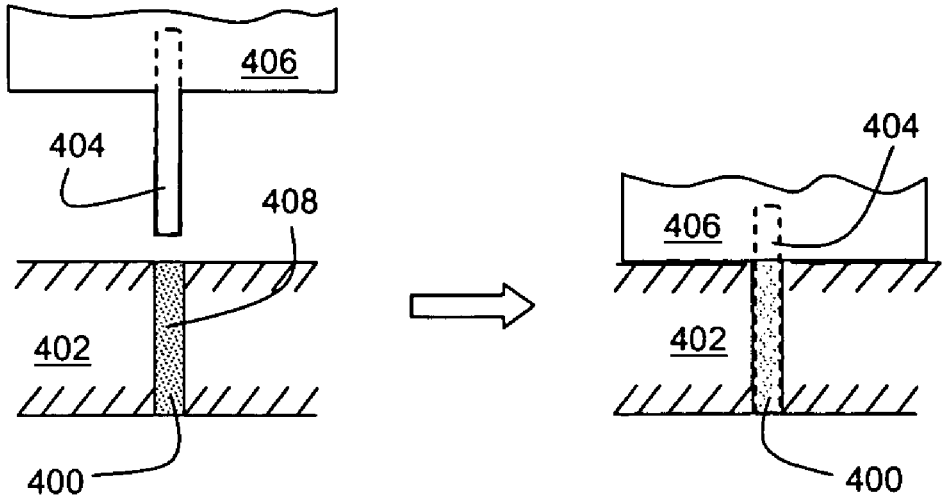
FIG. 4 is a side view of a compliant pin/PWA interface, according to an embodiment.
Figure 5:
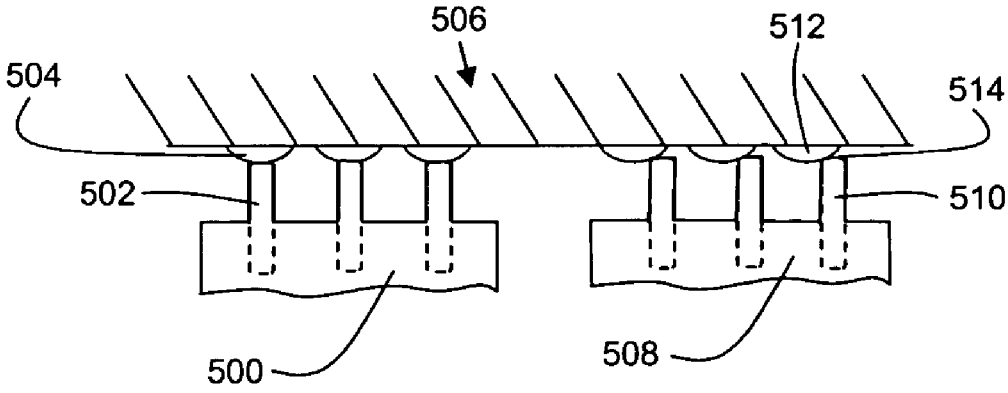
FIG. 5 is a side view of a spring probe/PWA interface, according to an embodiment.

Referring now to FIGS. 4 and 5, the interface between each end of a spring probe-compliant pin connector and a PWA is shown. In FIG. 4, a via 400 in a printed circuit board 402 may be a through aperture for receiving a compliant pin 404 of connector 406. Via 400 is typically coated or lined with an electrically conductive material 408, such as copper.

It can be appreciated that any of a number of electrically conductive materials known in the art may be used to line via 400. As shown in FIG. 4, when electrical connector 406 is brought into contact with PWA 402, compliant pin 404 is pressed through the conformal coating (not shown) of PWA 402 and seated or press fit into via 400. If necessary, connector 406 may be removed, however, the interface between compliant pin 404 and via 400 is such that connector 406 will remain affixed to PWA 402 without additional soldering, bonding, etc.

In FIG. 5, the spring probe-to-PWA interface is represented. As shown, a connector 500 with one or more spring probes, e.g. probe 502, may align well with the corresponding pads, e.g. pad 504, on a PWA 506. Near complete mechanical contact between probe 502 and pad 504 ensures electrical connectivity between connector 500 and PCB 506.

Alternatively, connector 508 in FIG. 5 highlights a significant advantage realized by the use of the spring probe-compliant pin connector of the present disclosure. As shown, each probe, e.g. probe 510, of connector 508 does not contact the corresponding pad, e.g. pad 512, along the entire contact surface 514 of the probe 510. Nonetheless, sufficient contact is established to allow current to flow between PWA 506 and connector 508. Stated differently, the use of a spring probe-compliant pin connector, e.g. connector 508, reduces the need for precise alignment between PWAs and connectors, thereby simplifying the PWA assembly process and reducing the damage to connector pins.

Figure 6:
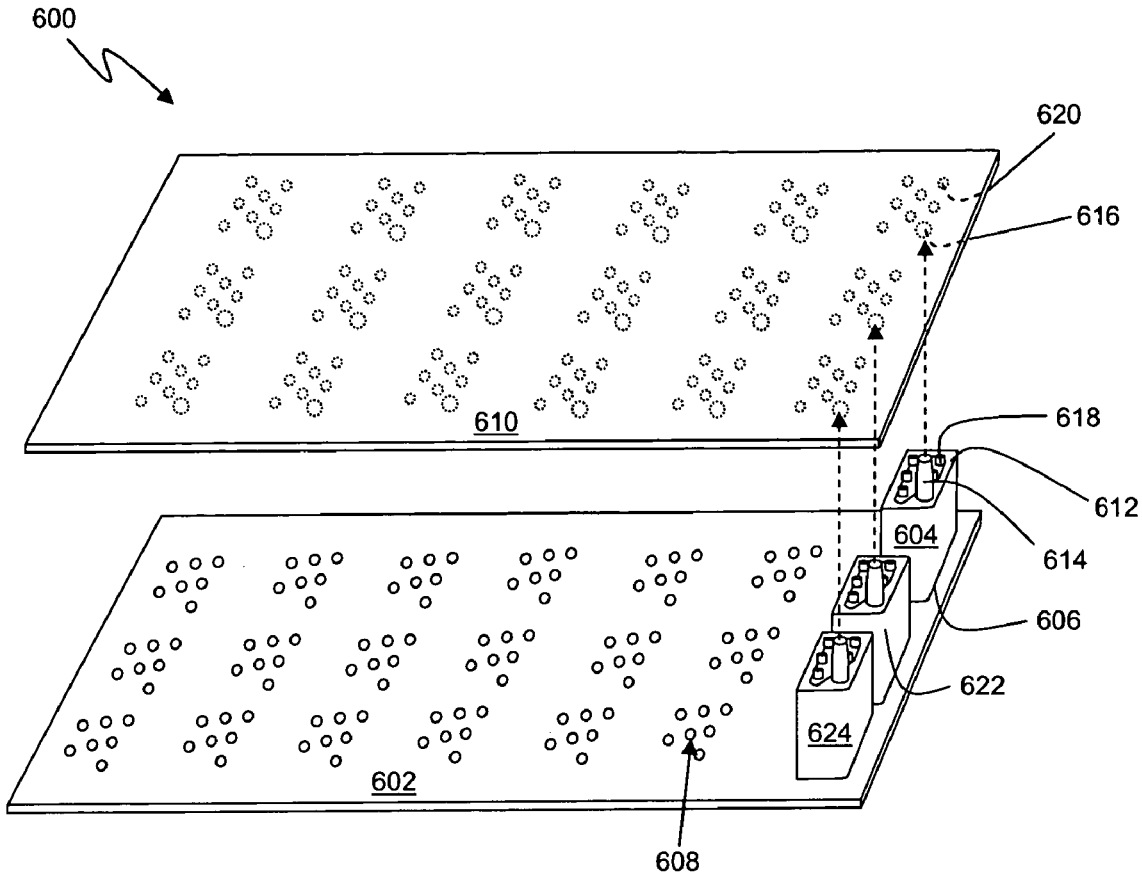
FIG. 6 is a perspective view of a PWA interconnected to a second PWA with spring probe-compliant pin connectors positioned therebetween, according to an embodiment.

Referring now to FIG. 6, a representative PWA to PWA assembly (or printed wiring architecture) 600 is presented. The PWA assembly includes a printed circuit board 602 for receiving one or more electrical connectors, e.g. connector 604. Specifically, PWA 602 interfaces with the "compliant pin end" 606 of spring probe-compliant pin connector 604. Of note, PWA 602 includes a plurality of interface apertures or vias, e.g. vias 608, which correspond to the number and pattern of compliant pins in the corresponding electrical connectors, e.g. connector 604. In at least one embodiment, connector 604, and other similar connectors, are inserted into PWA 602 as a preliminary step in the manufacture of PWA to PWA assembly 600.

A second PWA 610 interfaces with the spring probe end 612 of each connector, e.g. connector 604. More specifically, when the two PWAs 602, 610 are brought into close proximity, alignment pin 614 interfaces with an alignment aperture 616 (shown in phantom) in PWA 610. In this way, the alignment of the two PWAs 602, 610, and the alignment of connector 604 with board 610, is assured. Under a predetermined pressure applied between the two boards 602, 610, the spring probes of connector 604 (e.g. spring probe 618) contact the plurality of connector pads on PWA 610, of which connector pad 620 shown in phantom is exemplary. The force required to engage spring probe 618 with connector pad 620, and to establish electrical connectivity between PWAs 602, 610, is typically less than the force required to interconnect a PWA with standard connectors well known in the art. Further, disengagement is facilitated by the spring action of spring probe 620 as PWA 610 is separated from connector 604. It can be appreciated that each spring probe protruding from end 612 of connector 604 contacts a corresponding connector pad on PWA 610. With the use of spring probes and connector pads, the mating tolerance between connector 604 and PWA 610 is greater, and the risk of damage to a probe 618, a pad 620, a connector 604, or a board 610 is significantly reduced.

As shown in FIG. 6, multiple connectors, of which connectors 604, 622 and 624 are exemplary, are typically used to interconnect two PWAs, e.g. PWAs 602 and 610. The specific number of connectors used depends on the design of the PWAs, the number of required interconnect locations, etc. One advantage to using spring probe-compliant pin connectors 604, 622, 624 is that they may be mated to the PWAs 602, 610 after the manufacture of the PWAs is substantially complete. In particular, the connectors 604, 622, 624 may be installed and used after the conformal coating of the PWAs is complete. Connectors, e.g. connector 604, are inserted into a PWA, e.g. PWA 602, by pressing the compliant pins through the conformal coating and into the vias, e.g. vias 608.

Changes may be made in the above methods, devices and structures without departing from the scope hereof. It should thus be noted that the matter contained in the above description and/or shown in the accompanying drawings should be interpreted as illustrative and not in a limiting sense. The following claims are intended to cover all generic and specific features described herein, as well as all statements of the scope of the present method, device and structure, which, as a matter of language, might be said to fall therebetween.

What is claimed is:

1. An electrical connector comprising:

a housing;

at least one spring probe positioned in the housing for interfacing with at least one electrically conductive pad on a first member;

at least one compliant pin, positioned in the housing and in electrical communication with the at least one spring probe, for interfacing with at least one electrically conductive via in a second member;

an alignment pin integral to the housing; and a gasket positioned to seal the at least one spring probe and to stabilize an interface between the housing and the first member.

2. An electrical connector comprising:

means for transferring an electrical signal between a housing and an electrically conductive pad on a first member;

means for conveying the electrical signal between the housing and an electrically conductive via in a second member;

means, disposed within the housing, for interconnecting the means for transferring and the means for conveying, to facilitate the communication of the electrical signal between the first member and the second member;

means for aligning the connector with the first member; and means for sealing the means for transferring and for stabilizing an interface between the housing and the first member.

3. The connector of claim 1, wherein the means for transferring is at least one spring probe.

4. The connector of claim 1, wherein the means for conveying is at least one compliant pin.

5. The connector of claim 1, wherein the means for aligning the connector is an alignment pin, the alignment pin being integral to the housing.

6. The connector of claim 1, wherein the means for sealing and for stabilizing is a gasket.

* * * * *